US008794551B2

(12) United States Patent
Gomez

(10) Patent No.: US 8,794,551 B2
(45) Date of Patent: Aug. 5, 2014

(54) METHOD FOR MULTIPLEXING THE ELECTROSPRAY FROM A SINGLE SOURCE RESULTING IN THE PRODUCTION OF DROPLETS OF UNIFORM SIZE

(76) Inventor: Alessandro Gomez, Orange, CT (US)

( * ) Notice: Subject to any disclaimer, the term of this patent is extended or adjusted under 35 U.S.C. 154(b) by 2940 days.

(21) Appl. No.: 11/398,867

(22) Filed: Apr. 6, 2006

(65) Prior Publication Data

US 2007/0111146 A1 May 17, 2007

Related U.S. Application Data

(60) Provisional application No. 60/691,915, filed on Jun. 17, 2005.

(51) Int. Cl.
*B05B 5/00* (2006.01)
*B05B 1/14* (2006.01)

(52) U.S. Cl.
USPC ..... 239/690.1; 239/557

(58) Field of Classification Search
USPC ..... 239/690–708, 556–558; 431/2, 18, 258
See application file for complete search history.

(56) References Cited

U.S. PATENT DOCUMENTS 4,381,533 A * 4/1983 Coffee ..... 361/228
4,749,125 A * 6/1988 Escallon et al. ..... 239/3
4,788,016 A * 11/1988 Colclough et al. ..... 264/10
4,846,407 A * 7/1989 Coffee et al. ..... 239/690
5,044,564 A * 9/1991 Sickles ..... 239/690.1
5,503,335 A * 4/1996 Noakes et al. ..... 239/690
6,708,908 B2 * 3/2004 Heldt et al. ..... 239/700
6,755,024 B1 * 6/2004 Mao et al. ..... 60/776
7,455,250 B2 * 11/2008 Muljono ..... 239/696
2002/0003177 A1 * 1/2002 O'Connor et al. ..... 239/696

OTHER PUBLICATIONS

Technical Note, Multiple Jet Electrohydrodynamic Spraying and Applications, J. C. Almekinders et al., J. Aerosol Sci., vol. 30, No. 7, pp. 969-971, 1999.
Electrospraying of Conducting Liquids for Monodisperse Aerosol Generation in the 4nm to 1.8 μm Diameter Range, Da-Ren Chen, et al., J. Aerosol Sci., vol. 26, No. 6, pp. 963-977, 1995.
Electrostatic Spraying of Liquids in Cone-Jet Mode, M. Cloupeau et al., Journal of Electrostatics, vol. 22, pp. 135-159, 1989.

(Continued)

*Primary Examiner* — Len Tran
*Assistant Examiner* — Steven M Cernoch
(74) *Attorney, Agent, or Firm* — Carmody Torrance Sandak & Hennessey LLP

(57) ABSTRACT

The present invention is directed to a multiplex system for electrospraying an electrosprayable fluid to produce essentially uniform droplets in the cone-jet mode from multiple cone-jets anchored at the outlet of at least one atomizer when the at least one atomizer is in the presence of an electric field. The system comprises at least one electrode spaced from the outlet of the at least one atomizer such that the electric field is between the outlet of the at least one atomizer and the at least one electrode. The at least one atomizer is shaped for intensifying the electric field at discrete points at its outlet such that the electrosprayable fluid partitions into multiple monodispersed cone-jet electrosprays that anchor to the discrete points about the outlet of the at least one atomizer when a sufficiently intense electric field is present.

8 Claims, 15 Drawing Sheets
(5 of 15 Drawing Sheet(s) Filed in Color)

(56) References Cited

OTHER PUBLICATIONS

Electrostatic Spraying of Liquids: Main Functioning Modes, M. Cloupeau et al., Journal of Electrostatics, vol. 25, pp. 165-184, 1990.
Recipes for Use of EHD Spraying in Cone-Jet Mode and Notes on Corona Discharge Effects, M. Cloupeau, J. Aerosol Sci., vol. 25, No. 6, pp. 1143-1157, 1994.
Increase of Electrospray Throughput Using Multiplexed Microfabricated Sources for the Scalable Generation of Monodisperse Droplets, Weiwei Deng et al., Journal of Aerosol Science, pp. 1-19, May 2005.
Electrospray Ionization for Mass Spectrometry of Large Biomolecules, John B. Fenn et al., Science, New Series, vol. 246, No. 4926, pp. 64-71, Oct. 1989.
Jet Break-Up in Electrohydrodynamic Atomization in the Cone-Jet Mode, R. P. A. Hartman et al., J. Aerosol Sci., vol. 31, No. 1, pp. 65-95, 2000.
Investigations Into the Mechanisms of Electrohydrodynamic Spraying of Liquids, I. Hayati et al., Journal of Colloid and Interface Science, vol. 117, No. 1, May 1987.
Optimization of a Catalytic Combustor Using Electrosprayed Liquid Hydrocarbons for Mesoscale Power Generation, Dimitrios C. Kyritsis et al., Yale Center for Combustion Studies, Department of Mechanical Engineering, Combustion and Flame, vol. 139, pp. 77-89, 2004.
The Current Emitted by Highly Conducting Taylor Cones, J. Fernandez De La Mora et al., J. Fluid Mech., vol. 260, pp. 155-184, 1994.
Monodisperse Electrosprays of Low Electric Conductivity Liquids in the Cone-Jet Mode, Keqi Tang et al., Journal of Colloid and Interface Science, vol. 184, pp. 500-511, 1996, Article No. 0645.
On the Structure of an Electrostatic Spray of Monodisperse Droplets, Keqi Tang et al., American Institute of Physics, Phys. Fluids, vol. 6, No. 7, pp. 2317-2332, Jul. 1994.

* cited by examiner

METHOD FOR MULTIPLEXING THE ELECTROSPRAY FROM A SINGLE SOURCE RESULTING IN THE PRODUCTION OF DROPLETS OF UNIFORM SIZE

CROSS REFERENCE TO RELATED APPLICATIONS

This application claims the benefit of U.S. Provisional Application No. 60/691,915, filed Jun. 17, 2005, the subject matter of which is herein incorporated by reference in its entirety.

STATEMENT REGARDING FEDERALLY SPONSORED RESEARCH OR DEVELOPMENT

This invention was partially made with U.S. Government support from DARPA under Grant No. DAAD19-01-1-0664. Accordingly, the U.S. Government may have certain rights in this invention.

BACKGROUND OF THE INVENTION

Electrostatic means for liquid dispersion in minute droplets are used in a variety of technological applications, such as paint spraying, ionization for chemical analysis, drug inhalation, synthesis of particles from liquid precursors, and surface coating, by way of example and not limitation. The class of atomizers in which the dispersion of the liquid is driven exclusively by electric forces is referred to heretofore as electrospray (ES). Within this class of atomizers it is often desirable to tightly control the size distribution of the resulting aerosol. Such a system can be implemented by feeding a liquid with sufficient electric conductivity through a small opening, such as the tip of a capillary tube or a suitably treated "hole", maintained at several kilovolts relative to a ground electrode positioned a few centimeters away. The liquid meniscus at the outlet of the capillary takes a conical shape under the action of the electric field, with a thin jet emerging from the cone tip. This jet breaks up farther downstream into a spray of fine, charged droplets. In view of the morphology of the liquid meniscus, this regime is labeled as the cone-jet mode.

Among the key features that distinguish the cone-jet electrospray from other atomization techniques are: quasi-monodispersity of the droplets; Coulombic repulsion of the charged droplets, which induces spray self-dispersion, prevents droplet coalescence and enhances mixing with the oxidizer; and the use of a spray "nozzle" with a relatively large bore with respect to the size of the generated droplets, which implies that liquid line obstruction risks are minimized. The cone-jet mode can produce droplets/particles over a wide size range, from submicron to hundreds of micrometers, depending on liquid flow rate, applied voltage and liquid electric conductivity. Especially in the submicron range, the capability of producing monodisperse particles with relative ease is relatively unique as compared to other aerosol generation schemes.

Electrospray Ionization Mass Spectrometry (ESI-MS), spearheaded by the work of John B. Fenn at Yale in the 1980's, is a practical application of the electrospray in widespread use. Key drawbacks that have hampered applications to other areas are: the low flow rates at which the cone-jet mode can be established and the restrictions on the liquid physical properties of the liquids that can be dispersed with this technique. The difficulty is particularly severe in applications requiring that the initial droplet size be small, as for example in drug inhalation or nanoparticle synthesis.

The present invention was originally conceived for small-scale combustion of liquid fuels, which has become increasingly important, especially for small portable energy systems that are designed to be carried by an individual. For example, it may be desirable to equip a soldier with a lightweight and compact sources of electrical power and microclimate control, instead of more cumbersome and bulky battery packs. An electric power source based at least in part on the combustion of liquid fuels would exploit the much larger power density of liquid hydrocarbon fuels as compared to the best batteries currently in use today.

SUMMARY OF THE INVENTION

It is an object of the present invention to provide a multiplex system that produces multiple monodispersed cone-jet electrosprays about the outlet of an atomizer.

It is another object of the present invention to provide a multiplex system that is capable of producing multiple stable electrosprays about the outlet of an atomizer.

It is yet another object of the present invention to provide a method of using a multiplex system of the invention.

To that end the present invention is directed to a multiplex system that is capable of producing multiple stable cone-jet electrosprays about the outlet of an atomizer.

In a preferred embodiment, the present invention is directed to a multiplex system for electrospraying an electrosprayable fluid to produce droplets of essentially uniform size from multiple cone-jets from an outlet of an atomizer when the atomizer is in the presence of an electric field, the system comprising:

at least one electrode spaced from the outlet of the atomizer; wherein the electric field is between the outlet of the atomizer and the at least one electrode; and wherein the atomizer is shaped for intensifying the electric field at discrete points about the outlet of the atomizer, wherein the atomizer produces at least one cone-jet of fluid at the outlet when the electric field is present; and wherein the electrosprayable fluid partitions into multiple monodispersed cone-jet electrosprays that anchor at the discrete points about the outlet of the atomizer.

In another embodiment, the present invention is also directed to a mesoscale combustor for small scale power generation comprising:

a) a source of liquid fuel;

b) a multiplex system for electrospraying the liquid fuel to produce droplets of essentially uniform size from multiple cone-jets from an outlet of an atomizer when the atomizer is in the presence of an electric field, the system comprising:

at least one electrode spaced from the outlet of the atomizer; wherein the electric field is between the outlet of the atomizer and the at least one electrode; and wherein the atomizer is shaped for intensifying the electric field at discrete points about the outlet of the atomizer, wherein the atomizer produces at least one cone-jet of liquid fuel at the outlet when the electric field is present; and wherein the liquid fuel partitions into multiple monodispersed cone-jet electrosprays that anchor at the discrete points about the outlet of the atomizer; and c) means for igniting the liquid fuel downstream of the atomizer.

In yet another embodiment, the present invention is directed to a method of multiplexing an electrosprayable fluid from an outlet of an atomizer to produce droplets of essentially uniform size from multiple cone-jets, wherein the outlet of the atomizer is shaped for intensifying the electric field at discrete points about the outlet, and wherein the atomizer is capable of producing at least one cone-jet of fluid at the outlet when an electric field is present, the method comprising the steps of:

introducing and maintaining an electric field within which the outlet of the atomizer is present; and atomizing the electrosprayable fluid in the atomizer to partition the fluid into multiple monodispersed cone-jet electrosprays that anchor to the discrete points about the atomizer outlet.

Finally, it is also contemplated that additional multiplexing may be provided by providing multiple nozzles or atomizers that are each capable of partitioning an electrosprayable fluid into multiple monodispersed cone-jet electrosprays that anchor to discrete points about the atomizer outlet.

BRIEF DESCRIPTION OF THE FIGURES

The patent or application file contains at least one drawing executed in color. Copies of this patent or patent application publication with color drawing(s) will be provided by the Office upon request and payment of the necessary fee.

For a fuller understanding of the invention, reference is made to the following description taken in connection with the accompanying figures, in which.

Identical reference numerals in the figures are intended to indicate like features, although not every feature may be called out with a reference numeral.

DETAILED DESCRIPTION OF THE PREFERRED EMBODIMENTS

Figure 1:
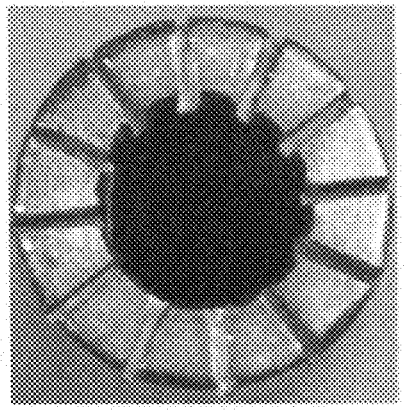
FIG. 1 depicts a view of the outlet of one embodiment of the atomizer of the present invention.

The electrospray of conducting liquids operated in the cone-jet mode has the unique ability of generating droplets essentially uniform in size over a phenomenal range of sizes depending primarily on the liquid flow rate and physical properties. Since there is a monotonic dependence of size on flow rate, the liquid flow rates that can be dispersed are modest if the goal is to produce very small droplets. At sufficiently high voltages a liquid that can be operated in the conventional cone-jet mode may disperse into a multitude of cone-jets emanating from a single bore and typically spreading out at an angle with respect to the axis of the nozzle through which the liquid is pumped. If these conditions can be controlled, the atomizer may be operated to provide stable operation in a compact, inexpensive multiplexing system, without sacrificing the crucial feature of monodispersity of the generated droplets.

If such a multijet mode is anchored at discrete points about the outlet, such as by using sharp features (e.g., grooves, ridges, etc.) machined or otherwise formed at the outlet of the atomizer, to intensify the electric field at discrete points around its perimeter, then the cone-jets are simultaneously anchored at these features and a stable mode of operation is identified over several hundreds of volts and a broad range of flow rates. In addition, so long as the machining of these features is precise, droplets generated do not vary significantly in size from spray to spray. As a result, a compact, inexpensive and versatile multiplexing system is realized without sacrificing droplet monodispersity. While the present approach to multiplexing has some similarity to the system described in U.S. Pat. No. 4,846,407 to Coffee et al., Coffee et al. does not provide any quantitative measurements of the electrosprayed fluid, the enhanced system stability, and the preservation of the uniformity of droplet size under suitable operating conditions, as described herein.

In a first embodiment, the present invention is directed to a multiplex system for electrospraying an electrosprayable fluid to produce droplets of essentially uniform size from multiple cone-jets from an outlet of an atomizer when the atomizer is in the presence of an electric field, the system comprising:

at least one electrode spaced from the outlet of the atomizer; wherein the electric field is between the outlet of the atomizer and the at least one electrode; and wherein the atomizer shaped for intensifying the electric field at discrete points about the outlet of the atomizer, wherein the atomizer produces at least one cone-jet of fluid at the outlet when the electric field is present; and wherein the electrosprayable fluid partitions into multiple monodispersed cone-jet electrosprays that anchor to the discrete points about the outlet of the atomizer, thereby yielding essentially uniform droplets of fluid that are smaller than the fluid droplets achievable with a single cone-jet electrospray in the same system.

In one embodiment of the invention, the outlet of the atomizer is substantially cylindrical. However, it is not required that the outlet be substantially cylindrical and other outlet shapes may also be used so long as it is possible to intensify the electric field at discrete points at the outlet.

If a substantially cylindrical outlet is used, preferably, the intensified electric field is at discrete points around the perimeter of the outlet of the atomizer.

The electrical field is typically established between the outlet of the atomizer and the electrode by charging and holding the electrode to a substantially different voltage from that of the atomizer.

Preferably, the atomizer outlet comprises a tube that is fabricated from a conductive material, such as brass or stainless steel, or a metallized non-conductive material. Although the dimensions of the tube are not critical, in one embodiment, the tube may have an inner outlet diameter of about 0.07 inches and an outer outlet diameter of about 0.125 inches.

In one embodiment, the atomizer outlet is shaped for intensifying the electric field at discrete points around the perimeter by arranging geometric features around the outlet of the atomizer. The shape of the geometric feature is not critical, and any means that is capable of locally increasing the electric field by reducing the local radius of curvature of the surface of the atomizer outlet may be used. Typically, these geometric features comprise channels, grooves, ridges, pins, or teeth, by way of example and not limitation. In a preferred embodiment, the geometric features are grooves or channels that are created in the atomizer outlet by way of wire electrical discharge machining. Each of the grooves or channels may have a width of between about 0.003 inches to about 0.008 inches and a depth of about 0.003 inches to about 0.008 inches. However, these dimensions are dependent on the size of the atomizer outlet and on the manufacturing technique. Thus, they are given by way of example and not limitation. In one embodiment, the geometric features are arranged at least substantially symmetrically around the outlet of the atomizer.

Furthermore, depending on the size of the atomizer outlet, the number of grooves or channels may be between a few (i.e. 3) and as many as can be fitted onto the outlet of the atomizer, depending in part on the manufacturing technique. In one preferred embodiment, twelve grooves or channels may be created in the atomizer outlet by way of wire electrical discharge machining using either a brass or stainless steel tube with an outer diameter of about 0.125 inches. On the order of at least twice as many grooves or channels can be accommodated on the same size tube using thin wire electrode discharge machining.

The system of the invention also typically comprises means for introducing and maintaining an electric field between the atomizer and the at least one electrode, which in one embodiment may be a ground electrode.

In another embodiment, the present invention is directed to a mesoscale combustor for small scale power generation comprising:

a) a source of liquid fuel;

b) a multiplex system for electrospraying the liquid fuel to produce droplets of essentially uniform size from multiple cone-jets from an outlet of an atomizer when the atomizer is in the presence of an electric field, the system comprising:

at least one electrode spaced from the outlet of the atomizer; wherein the electric field is between the outlet of the atomizer and the at least one electrode; and wherein the atomizer shaped for intensifying the electric field at discrete points about the outlet of the atomizer, wherein the atomizer produces at least one cone-jet of liquid fuel at the outlet when the electric field is present; and wherein the liquid fuel partitions into multiple monodispersed cone-jet electrosprays that anchor at the discrete points about the outlet of the atomizer; and c) means for igniting the liquid fuel downstream of the atomizer.

The liquid fuel typically comprises a liquid hydrocarbon, such as heptane or jet fuel (e.g. JP8) that has been doped with a small amount (e.g. <0.3% by weight) of an electric conductivity enhancer.

The means for igniting the liquid fuel is not critical to the practice of the invention and is typically any means known in the art for igniting liquid fuel, including by way of example and not limitation, various hot wires, glow plugs, and spark plugs.

In another preferred embodiment, the present invention is directed to a method of multiplexing an electrosprayable fluid from an outlet of an atomizer to produce droplets of essentially uniform size from multiple cone-jets, wherein the outlet of the atomizer is shaped for intensifying the electric field at discrete points about the outlet, and wherein the atomizer is capable of producing at least one cone-jet of fluid at the outlet when an electric field is present, the method comprising the steps of:

introducing and maintaining an electric field within which the outlet of the atomizer is present; and atomizing the electrosprayable fluid in the atomizer to partition the fluid into multiple monodispersed cone-jet electrosprays that anchor to the discrete points about the atomizer outlet.

The preferred method of the invention enhances the current that is curried by the fluid at a given flow rate as compared to systems in which no multiplexing is applied.

The electrosprayable fluid typically comprises a liquid of finite electric conductivity. Non-limiting examples of electrosprayable fluids usable in the invention include water, aqueous solutions, liquid hydrocarbons such as heptane and jet fuels, alcohols such as methanol and ethanol, and combinations of one or more of the foregoing. The electrosprayable fluid may also optionally contain a small amount of an electrical conductivity enhancer.

The droplet size of the monodispersed fluid depends at least in part on the particular application as well as the design parameters of the multiplex system. However, it is generally desirable that the droplet size of the monodispersed fluid have a relative standard deviation of less than about 10 percent.

While the flow rate of the electrosprayable fluid is not critical, it is generally desirable that the flowrate of the electrosprayable fluid through the atomizer be between about 2 and about 40 ml/hour depending on the particular application. In addition, the flow rate of fluid is also at least substantially uniformly distributed among the multiple monodispersed cone-jet electrosprays. The inventors have also determined that multiplexing the electrosprayable fluid enhances the current carried by the electrosprayable fluid at a desired flow rate.

As discussed above, the outlet of the atomizer is shaped for intensifying the electrical field at discrete points around the perimeter by positioning geometric features, such as channels, grooves, ridges, pins, or teeth, at least substantially symmetrically around the outlet of the atomizer. In this manner, the electrosprayable fluid may be anchored to the geometric features at the top of each feature or just inside each feature, by way of example and not limitation. Furthermore, a voltage range and a liquid flow rate range within which stable operation can be established are significantly broader than in the absence of the geometric features, and the stability of the at least one cone-jet electrospray at the atomizer outlet can be enhanced.

In addition, the level of multiplexing may match or exceed the number of features (e.g. grooves or channels) on the outlet of the atomizer. For example, depending on various factors, such as flowrate, at least one cone-jet of fluid is typically anchored to each geometric feature, and in some embodiments, two or more cone-jets of fluid may be anchored to each geometric feature.

While reference has been made above to a single atomizer that is capable of producing multiple monodisperse electrosprays, the present invention also contemplates the use of multiple nozzles or atomizers to produce additional multiplexing of the electrospray.

In one embodiment, additional multiplexing may be realized by utilizing a microfabricated array of nozzles that have been shaped at the outlet in the manner described above to intensify the electric field at discrete points around the perimeter by arranging geometric features around the outlet of each of the nozzles in the array of nozzles. An example of a suitable multiplexed system using a microfabricated array of nozzles is described in related International Publication No. WO 2006/009854, the subject matter of which is herein incorporated by reference in its entirety.

Figure 5:
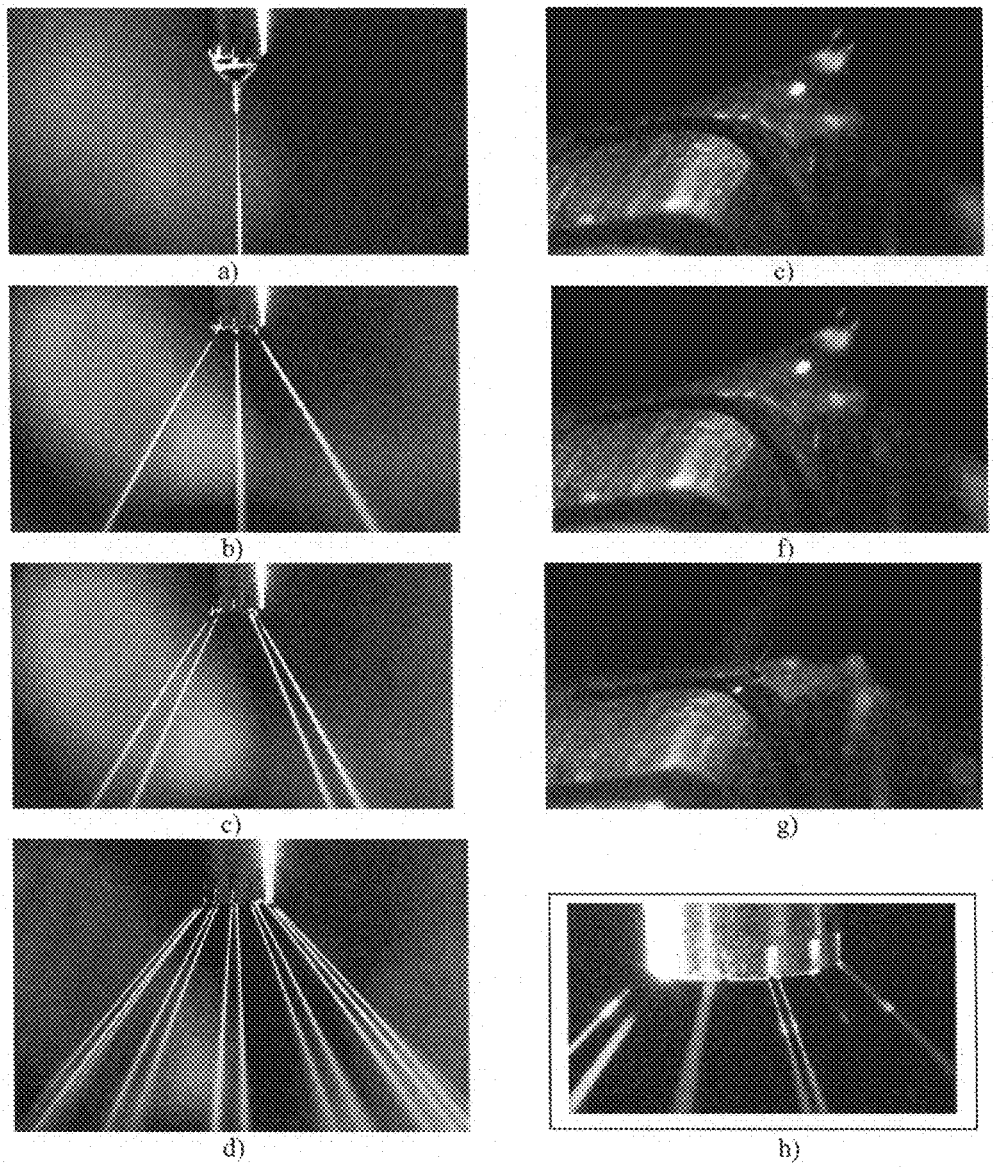
FIG. 5 depicts pictures of various modes of operation, with close-up views of the voltage effect in the grooved mode.
Figure 13:
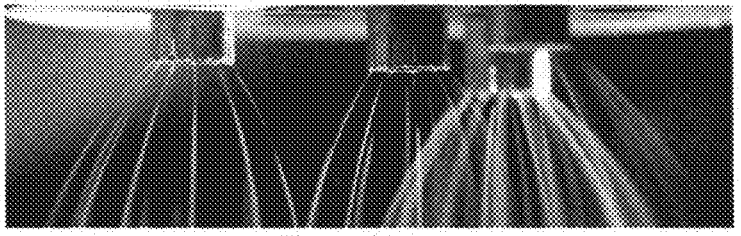
FIG. 13 depicts pictures of multiple multiplexed grooved atomizers.
Figure 14:
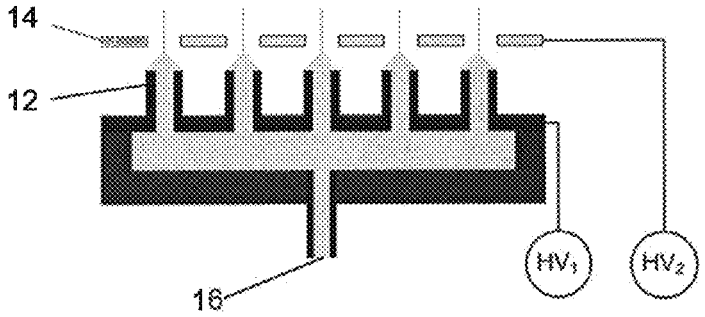
FIG. 14 depicts a schematic of an array of substantially uniform nozzles that are capable of producing droplets of essentially uniform size from multiple conejets.

Thus the present invention also contemplates a microfabricated multiplex system for electrospraying an electrosprayable fluid to produce droplets of essentially uniform size from multiple cone jets from an integral array of substantially uniform nozzles. As shown in FIG. 14, the system comprises:

a) an array of substantially uniform nozzles 12, wherein the nozzles 12 may be shaped for intensifying the electric field at discrete points about an outlet of the nozzles by arranging geometric features around the outlet of each nozzle (see e.g., FIGS. 5 and 13);

b) at least one extractor electrode array 14 positionable at a distance from the top of the array of nozzles 12;

c) at least one insulating spacer arranged between the array of substantially uniform nozzles and at least one the extractor electrode array to position the at least one extractor electrode array at the desired distance from the top of the array of substantially uniform nozzles;

d) a source of fluid 16 operably connected to the array of substantially uniform nozzles 12 for providing the fluid to be electrosprayed; and e) electrical means (High Voltage 1 (HV1) and High Voltage 2 (HV2)) for maintaining a desired voltage drop between the array of substantially uniform nozzles 12 and the at least one extractor electrode array 14.

In addition, the present invention also contemplates a method of producing droplets of essentially uniform size from an array of nozzles, wherein the outlet of each nozzle of the array of nozzles is shaped for intensifying the electric filed at discrete points about the outlet by arranging geometric features around the outlet of each nozzle, wherein each nozzle of the array of nozzles is capable of producing at least cone-jet of fluid at the outlet when an electric field is present, the method comprising the steps of:

a) introducing and maintaining an electric field within which the outlet of each nozzle of the array of nozzles is present; and b) atomizing the electrosprayable fluid in the array of nozzles to partition the fluid into multiple monodispersed cone-jet electrosprays that anchor to the discrete points about the outlet of each nozzle of the array of nozzles.

The present invention may be further described by reference to the experimental system described below and the subsequent non-limiting examples.

Experimental System

The experimental system comprised a syringe pump to feed and meter precise liquid flow rates through a metal tube acting as the electrospray source. A Teflon® tube connected the syringe needle to the metal tube at the outlet of which the electrospray was anchored. For the reference experiments in the single cone-jet mode, two tubes were used: a larger one (1.6 mm O.D., 1.2 mm I.D.) and a capillary (1.6 mm O.D., 0.11 mm I.D.). For the multi-jet mode of operation, two large tubes were used with approximately the same dimensions (3.2 mm O.D., 1.8 mm I.D.). The first tube was brass and had its outlet machined flat and polished. The other tube was stainless steel that was machined at one end with 12 grooves using wire electrodischarge machining (EDM) to ensure good reproducibility of the geometric features of each groove (FIG. 1). The metal tube was charged at an electrical potential of several kilovolts. At a distance of a few centimeters from the tip of the metal tube was positioned a flat ground electrode, comprising a metal ring covered with a metal mesh to prevent liquid accumulation on the electrode.

The current in the experimental system was measured by connecting the virtual ground plate to a voltmeter of known input impedance. Visual observation of the mode of operation was made through a telescope focused on the liquid meniscus. To count the jets accurately, a He—Ne laser beam was focused into a sheet by two lenses and shone perpendicularly to the axis of the metal tube, a few millimeters downstream of the cone-jets. Scattering of the charged droplets in each spray resulted in the visualization of individual spray cross sections appearing as small discs.

Heptane was electrosprayed with an electrical conductivity enhancer, Stadis® 450 (available from Octel-Starreon, LLP), at a concentration of 0.3% by weight. The selection of a liquid fuel for testing was motivated by the need to apply the technique to the dispersion of liquid fuels in the development of a mesoscale combustor.

Before loading the liquid in the syringe, it was sonicated for a few minutes and care was taken in the loading procedure to minimize the formation of microbubbles.

The liquid conductivity was measured by feeding the liquid through a small Teflon tube with a metal capillary at each outlet. By applying different potentials across the capillaries and measuring the current in the circuit, the resistance of the liquid could be inferred. From $$R = \frac{l}{k \times A},$$

where k is the electrical conductivity, A the cross section and l the length of the Teflon tube, one can calculate the conductivity. The underlying assumption is that the circuit consists of two resistances in parallel, with the Teflon resistance orders of magnitude larger than the liquid. The electric conductivity of the solution was measured at $1.4\times10^{-6}$ $Sm^{-1}$. The other physical properties of the fluid were not affected by the additive.

Different syringe sizes were used to ensure that the plunger would be displaced at a reproducible and accurate speed. For the low flow rates, small syringes (0.25 or 1 ml) were used. Indeed, the smaller the diameter of the syringe, the more accurate and steady the motion of the syringe plunger. As a result, the measurement of the current was more accurate and the range of stable flow rates for a given mode was broadened.

Droplet sizes were measured by a Phase Doppler Anemometer (DANTEC, Electronik) capable of measuring simultaneously droplet size and two velocity components from the scattering of a frequency-modulated Argon Ion laser beams (Spectra Physics). The electrospray set-up was mounted on a multi-direction translational stage allowing for the systematic scanning of the spray by the laser probe volume. This volume was imaged on the receiver optics, which was coupled to photomultipliers for the recording of the signal and subsequent processing. A dedicated electronic processor sampled and analyzed the signal using Dantek BSA Flow Software. For each measurement, 5000 counts per sample were taken for the statistics to be representative. Measurements were performed at a given flow rate by selecting the applied voltage so that the size distribution histogram would be as monodisperse as possible. In the cone-jet mode, although the bulk of the flow rate is dispersed in uniform size droplets, a small percentage is generally dispersed as much smaller satellites, unless special care is taken to identify conditions/methods avoiding the satellite formation. These satellites are electrostatically and inertially confined to the periphery of the spray. To ensure that the primary droplets were sized up, the laser probe volume was positioned along the axis of each spray.

EXAMPLES

Reference Example 1

Multiplexing from a Single Smooth Tube

Figure 2:
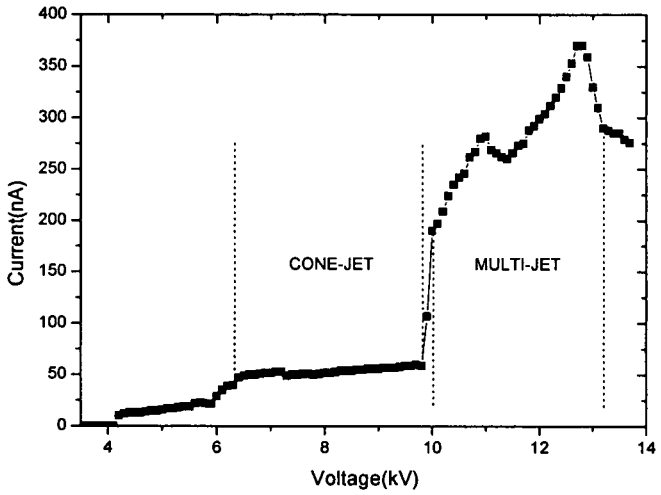
FIG. 2 depicts a graph of current versus voltage for a smooth tube ($\dot{Q}$=30 ml/hr).

FIG. 2 depicts a typical current versus voltage graph, obtained by electrospraying heptane in the multijet mode using a large brass metal tube with a polished end, as discussed above. FIG. 2 is used as a reference to contrast the well-known behavior in the multi-jet mode to what is found when the tip of the atomizer is suitably modified, as in the present invention and as depicted in FIG. 4, which is discussed in more detail below. In the lower voltage range (6.5-8.0 KV), a single cone-jet appeared, with blurred contour suggesting an inherently unstable mode of operation. As the voltage was raised in the multijet range of operation, the few jets appeared and could be anchored stably at positions equidistanced from each other. If the voltage was raised further, more cone-jets appeared. At the peak current, at about 12.5 KV, on the order of 20 cone-jets were present at the edge of the tube, however, the jets were not very stable.

Figure 3:
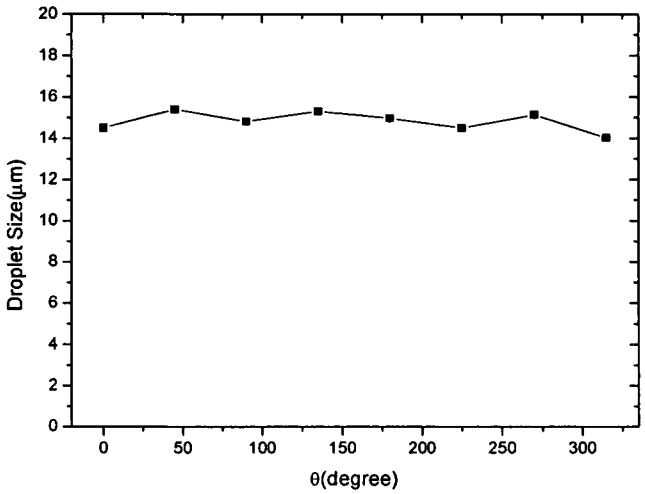
FIG. 3 depicts the average droplet diameter in individual cone-jet electrosprays anchored in the multi-jet mode to a smooth atomizer ($\dot{Q}$=30 ml/hr; on the order of 25 jets).

The application of Phase Doppler Anemometry enabled the measurement of the size of the droplets generated in each jet. Surprisingly, the average size from spray to spray was quite uniform, as depicted in FIG. 3, in which the variability of the average droplet size in each spray was plotted versus the azimuthal coordinate, ∂. Within each spray the size distribution was quasi-monodisperse, with typical size spread, defined as $(D_{0.9}-D_{0.1})/D_{0.5}$, less than 0.1. In the above relationship, $D_i$ represent the value for which i-fraction of the liquid volume is in droplets of smaller diameters. This result suggests that the multijet mode consists of an array of monodisperse cone-jet electrosprays. The apparent instability of the regime is merely the result of some positional jitter of the individual cone-jets, rather than more serious instabilities that would affect the size distribution of the generated droplets. The uniformity in size suggests that the total flow rate is equipartitioned evenly among the coexisting cone-jets, if, as in the present case, efforts are made to ensure symmetry in the geometry of the electrodes and the liquid injection. Repeating the same current/voltage experiment at 20 ml/hr yielded similar results.

At low flow rates, i.e. 6 ml/hour, however, results were quite different. The cone-jet was never effectively stabilized, even with fewer jets. In addition, the average flow rate per jet is still be well above the minimum flow rate that can electrosprayed in an individual cone-jet for such a mixture, although direct comparisons are difficult to make since this variable depends on the electrode configuration.

Thus, the multi-jet mode was seen to be surprisingly effective at generating monodisperse droplets without the need of special manufacturing approaches. Yet, the range of flow rates over which this regime applies with an appreciable level of multiplexing of at least one order of magnitude is narrow and, even within this range, the number of jets is very sensitive to the applied voltage. This result poses two problems from an application viewpoint: first, the disappointing behavior at low flow rates suggest that the approach would fail precisely in the potentially most interesting regime in which the smallest droplets would be generated, which would be the one of interest in some of the high-value added applications; second, the variability of the number of jets with voltage and their positional instabilities suggest that in a "production mode" the electrospray would have to be constantly monitored and the applied voltage frequently tweaked to the design operation.

Example 2

Grooved Mode of Operation of the Invention

The observation that the cone-jet instability was positional, in the sense that conditions seem rather stable and promising from a monodispersity perspective, led to the attempt to anchor the multijet regime by designing identical geometric features at the atomizer outlet in a symmetric pattern, for the purpose of stabilizing the cone-jets at particular locations around the opening circumference. To that end, a number of grooves were machined on the tube face by wire electric discharge machining, as depicted in FIG. 1. The grooves would anchor the multiple jets, once a sufficiently high voltage was applied with respect to a ground electrode, by virtue of the small radius of curvature and more intense electric field present at these locations. In that respect the shape of the indentation in the surface is not critical and may for example, be grooves, channels, teeth, or pins, by means of example and not limitation, as discussed above.

Solutions of Laplace equation for the electric potential between the two electrodes were carried out with different spatial resolution using FEMlab (COMSOL Inc., 2005) for a simplified nozzle geometry with four grooves. The field, computed at the outermost radial location, revealed the presence of spikes, corresponding to the location of the grooves, where the first intensity is at least a factor of two larger than the background value along the rest of the circumference. Since no account was taken of the presence of the liquid that was wetting the surface nor of the charged droplets and attending space charge, the results are to be considered qualitative. Nevertheless, they are revealing since they show a periodic electric field along the circumference of the nozzle, with peaks in correspondence to the grooves that are dramatically larger than the background field at the nozzle, as intuitively anticipated from first principles. As shown below, under certain conditions, these spikes in field strength at the grooves may be sufficient to lock otherwise unstable cone-jets in place. Furthermore, the multi-jet regime can be reached at an operating voltage lower than in the case of smooth nozzles, thereby minimizing the risk of electric discharge.

Figure 4A:
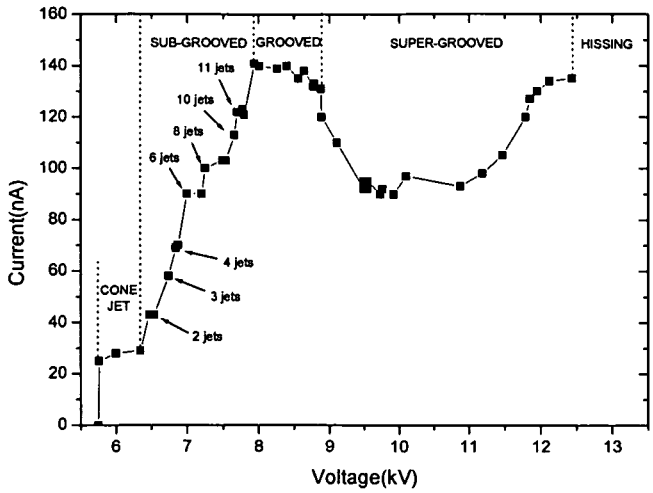
FIG. 4 depicts a graph of current versus voltage for a grooved tube operated in accordance with the present invention at $\dot{Q}$=6 ml/hr (a) and $\dot{Q}$=30 ml/hr (b).
Figure 4B:
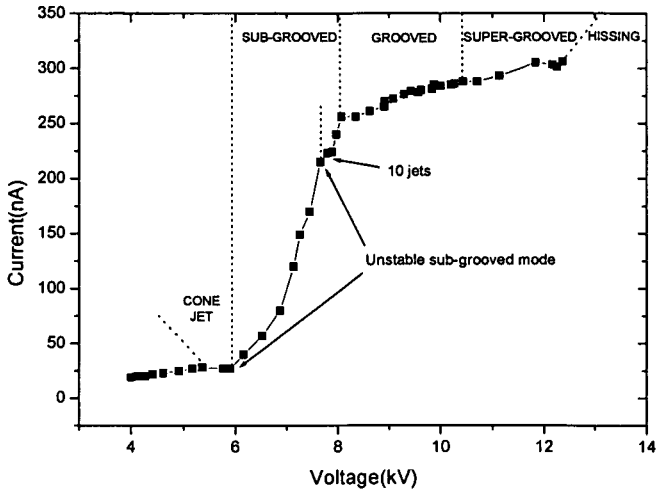

FIG. 4 depicts typical current versus voltage graphs, obtained for the same liquid at two flow rates, 6 ml/hr (FIG. 4*a*) and 30 ml/hr (FIG. 4*b*). FIG. 5 depicts several pictures that were obtained under different conditions, as explained in more detail below. In FIG. 4*a*, a more or less monotonic increase of the current in a step-ladder pattern is demonstrated, as the spray transitioned from a well pronounced initial plateau, corresponding to the single cone-jet (FIG. 5*a*), to a multi-jet regime with anywhere from 2 to 11 jets. FIGS. 5*b* and 5*c* show the morphology in some of the initial phase of this transition, with the appearance of 3 and 4 equidistanced jets along the tube circumference. This regime in which the number of jets is smaller than the number of grooves in the atomizer tip is labeled the "sub-grooved" mode. Next, as the voltage was further raised, a new plateau was reached, spanning several hundred Volts, within which the grooved regime was established, with as many jets as there are grooves (FIG. 5*d*). The current was nearly constant in this mode and, as the voltage was raised, each cone-jet shrunk. The cone-jet appearance is documented in the sequence of FIGS. 5*e-g* and is consistent with observations made in the single cone-jet mode, reporting shrinkage of the cone as the voltage rises.

In addition, the anchoring of the cone-jet may occur either at the top of the groove or directly inside the groove. Beyond 9 KV, the current surprisingly dipped in correspondence of a collapse of the grooved mode: some jets were, in fact, disappearing and leaving their groove empty, while others appeared in grooves that had already been occupied. As the current began to rise again, more and more jets formed and several, but not all of the grooves anchored two jets. FIG. 5*h* shows one such an example. Finally, at the highest voltage, a hissing sound becomes audible, which was a prelude to corona discharge and unstable spray disruption. Beyond this limit, the cone-jets were not stable but appeared to vibrate in the grooves. Similar graphs were obtained at higher flow rates, as in FIG. 4*b* corresponding to 30 ml/h. The trends are similar to the lower flow rate case with some noteworthy differences:

a) in the transition from single cone-jet to grooved mode, the current increase showed less of the staircase pattern that had been observed at 6 ml/hr and becomes strictly monotonic;
b) in this transition, it was difficult to establish a sub-grooved regime with few jets;
c) the current in the grooved mode increased, rather than being constant as the flow rate increased;
d) the dip in current, past the grooved regime, became less and less noticeable as the flow rate increased and the flow rate transitioned to a condition, in which the flow rate effluxing through a single groove was split into two stable jets, resulting in a total of 24 jets. While this regime is potentially the most desirable in terms of multiplexing, it did not appear to be as stable as the grooved mode, although its stability improved as the flow rate increased; and
e) eventually, also at larger flow rates, the hissing regime was reached.

A comparison of the system behavior of the grooved mode versus the results obtained in FIG. 2 for a smooth nozzle suggests that the stability of the system is improved significantly, as further elaborated below.

Current and Stability Domain

Figure 6:
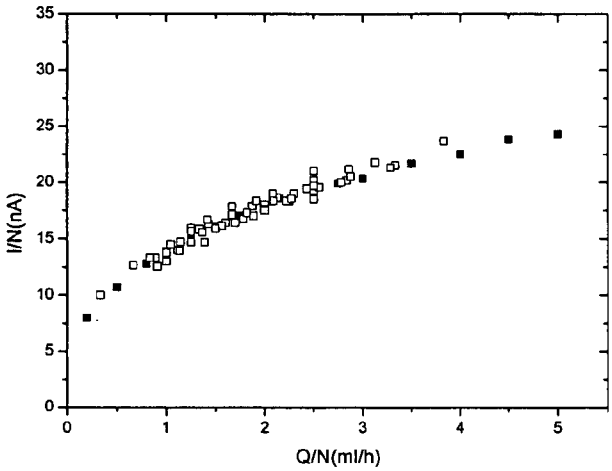
FIG. 6 depicts a graph of current versus flow rate for a multijet of heptane and 0.3% of Stadis (open symbols: average values for multi-jet; full symbols: single cone-jet).

To relate the behavior of the multi-jet regime to the better known single cone-jet mode, the average current per jet was compared to that measured in a separate experiment with the smaller tubes operated in the single cone-jet regime. In other words, with the electrospray in either the sub-grooved mode or grooved mode, that is with up to 12 jets, the total current was measured and the number of jets were counted, with the ratio of the values yielding the average current per jet. The results were plotted and are depicted in FIG. 6. It appears that the average current per jet obeys, within the experimental scatter, the same power law as in the single cone-jet mode. As a result, the current power law for the multijet must be close to that of the single jet.

The relative behavior of multi-jet mode was compared against the single cone-jet counterpart. Part of the scatter may be due to small variations in current that depends on the number of jets, with the grooved mode resulting in the largest current per jet. The average current per jet scales with the average flow rate per jet as $I/n \sim (Q/n)^{0.36}$, which is essentially the same, within the experimental scatter, as $I \sim Q^{0.35}$ obtained for the single cone-jet mode. This finding can also help explain the results of FIG. 4 on the current increase as more and more jets appear. In fact, $$I = \sum_{1}^{n} I_i \propto \sum_{1}^{n} \dot{Q}_i^{\alpha} = \sum_{1}^{n} \left(\frac{\dot{Q}}{n}\right)^{\alpha} = n^{(1-\alpha)}\dot{Q}^{\alpha}$$

where $\alpha$ is the exponent of the power law, n is the number of jets, $\dot{Q}$ is the total liquid flow rate, and $\dot{Q}_i$ is the flow rate through the i-cone-jet. The second equality relies implicitly on the assumption that the flow rate is uniformly distributed among the n cone-jets, as will be confirmed below. At constant total flow rate, $\dot{Q}$, the current increases as n increases, consistently with the findings in FIG. 4. The dip at low flow rates and high voltage in FIG. 4*a* suggests that the system must be operating in a rather unstable mode, with probable loss of monodispersity. Within the grooved mode, the reasonably constant current in FIG. 4*a* is also consistent with the equation above. At higher flow rates, on the other hand as in FIG. 4*b*, as the voltage is increased in the grooved mode, the current increases by 10% or so.

More generally, the implication of the above equation is that if the application for which the electrospray is used requires the highest possible charging of the liquid, as for example in ESI-MS, the multijet mode will yield a current gain by a factor $n^{1-\alpha}$ in the current passed through the spray, where $\alpha$ is invariably less than unity (even in the case of polar liquid for which the value of 0.5 is well-established).

Figure 7:
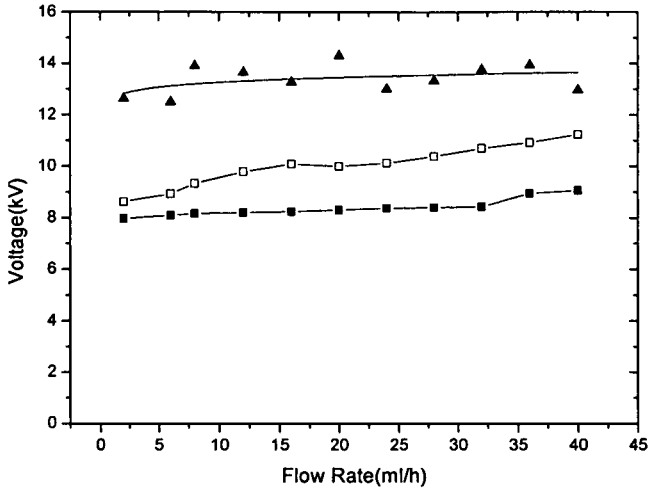
FIG. 7 depicts a graph of the stability domain in the voltage/flow-rate plane for the grooved multi-jet mode (full squares: Voltage onset; open squares: upper voltage of grooved mode; full triangles: hissing mode).

In order to minimize the scatter in the comparison of the single cone-jet with the multi-jet mode, it was decided to focus subsequent measurements only on the grooved regime, yielding the highest level of stable multiplexing. Indeed, this mode appears to be better defined, as the curves current-voltage for various flow rates shown in FIG. 4. A voltage-flow rate stability domain, which shows the operational domain of this regime, is shown in FIG. 7. The lowest curve is the onset value of voltage for which the 12 jets are well anchored in the grooves, the intermediate line corresponds to the onset voltage of the supergrooved regime, with more than 12 jets appearing, the upper curve correspond to the hissing mode, a regime beyond which corona discharge will occur. This stability domain confirms that the range of operating voltages for the grooved mode is relatively large on the order of 1-2 KV, which is sufficiently broad to ensure easy establishment of this regime in a practical use of the invention. Similar behavior was observed with other hydrocarbons such as JP-8, which is of interest in using the multiplexing system of the present invention in the development of mesoscale combustors. This result can be contrasted with the far more unstable behavior of the system with a smooth nozzle, as discussed in connection with FIG. 2.

Droplet Size Measurements

Figure 8:
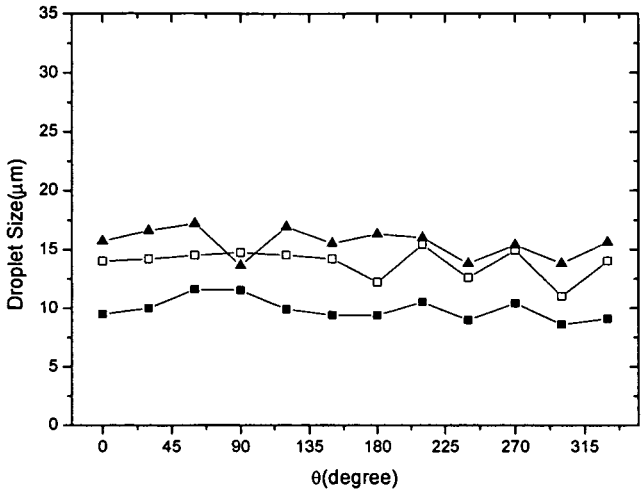
FIG. 8 depicts the average droplet diameter at different flow rates in individual cone-jet electrosprays anchored in the grooved mode to the grooved atomizer (full squares: $\dot{Q}$=6 ml/hr; open squares: $\dot{Q}$=12 ml/hr; full triangles: $\dot{Q}$=18 ml/hr).

The comparison of current power laws in the single cone-jet mode and multi-jet modes suggest that each cone-jet in the multi-jet regime behaves in the same way as an isolated cone-jet. Confirmation of this observation was sought with respect to the monodispersity of the generated droplets and their uniformity from jet to jet. Since the grooves are symmetrically and uniformly disposed, except for machining imperfection or asymmetries in the liquid pumping system, there is no reason to expect that the flow rate be not equipartitioned (or divided) among the multiple cone-jets, which should lead to uniformity throughout the spray cloud. Confirmation of this supposition with respect to the uniformity of the jets, and hence that of the flow rate, can be offered by the measurements of the size of the droplets emerging from the jet, thanks to the monotonic relation between the flow rate and the droplets size as shown for the single cone-jet. FIG. 8 presents the average droplet size for 3 flow rates, 6 ml/h, 12 ml/h and 18 ml/h, respectively. To quantify the size scatter from jet to jet, a relative standard deviation (RSD) is defined as $$RSD = \frac{1}{\overline{D}}\sqrt{\frac{\sum_{i=1}^{N}(\overline{D}_i - \overline{D})^2}{n-1}},$$

where $\overline{D}_i$ is the average droplet diameter for jet i, and $\overline{D}=\Sigma\,\overline{D}_i/n$ is the droplet size averaged over all jets. The uniformity of the droplet size was good, with the RSD<10%, which is comparable to the degree of non-uniformity in size within a single jet. The relative standard deviation was found to be significantly larger in the sub-grooved mode, which is another indirect confirmation that flow equipartition is improved in the grooved mode.

Figure 9:
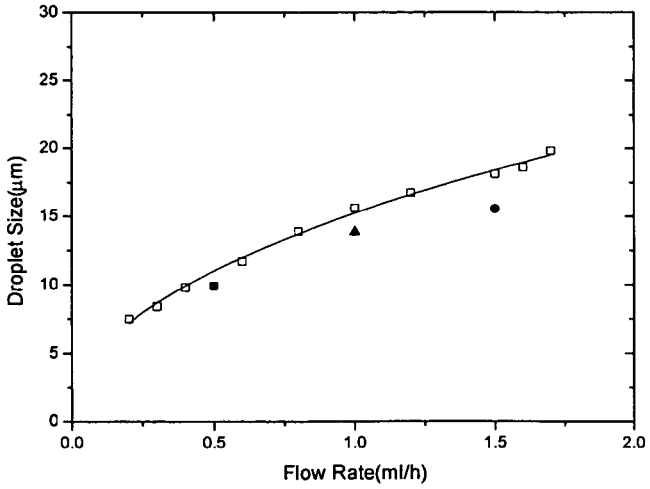
FIG. 9 depicts a graph of the comparison of droplets size dependence on flow rate. Open squares: droplet diameter versus flow rate for single cone-jet. Full triangles: average droplet diameter versus average flow rate per cone-jet in the multi-jet regime.

In FIG. 9 the average droplet diameter in the grooved mode was plotted versus the average flow rate $\dot{Q}/n$ and compared with data obtained in the single cone-jet mode for which n=1. The results for the multi-jet regime appear to be consistent with the size versus flow rate curve of the single jet. However, the scatter of the points plotted for the grooved mode is non-negligible, e.g. 15% at 18 ml/h. The discrepancy seems to increase with the flow rate, which may be attributed to the fact that the range of voltage within which the grooved mode is operated becomes larger for large flow rates. As a consequence of the measurement technique, the droplet size might have been measured for a voltage somewhat higher than the onset value. For a given flow rate, the droplets size decreases when the voltage increases, particularly at large flow rate.

Example 3

Groove Geometry, Size Uniformity and Machining Accuracy

The influence of geometric parameters on the electrospray behavior, including: number of grooves, groove width and depth, was also assessed and demonstrated that the first two parameters are the most important. Depending on the width of the groove, either one or two cone-jets per groove can be stabilized. However, there is a tradeoff between widening the groove and fitting more grooves on the annular surface at the outlet of a tube.

Figure 10:
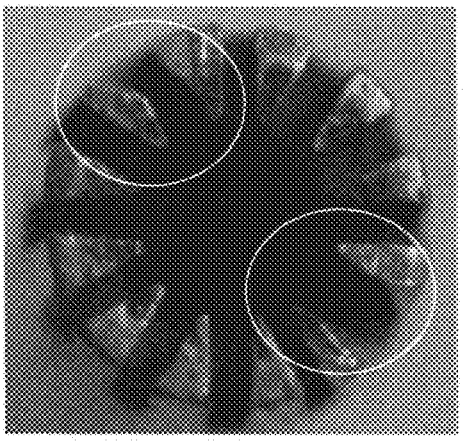
FIG. 10 depicts a picture of a grooved atomizer of the invention with deliberately induced fabrication damages in two circled areas.

A detailed examination of the size variation from jet-to-jet in similarly grooved atomizers that had been machined with a small blade, less reproducibly than with wire EDM, showed some pattern of the average size with jet position which was repeated for almost all the measurements and seemed to correlate with fabrication defects. This observation raised the concern that nonuniformities may stem from machining defects at the edge of the grooves, and this theory was checked by deliberately introduced defects that significantly worsen the non-uniformity from jet to jet. To that end, a grooved atomizer was damaged in two positions, as highlighted by the circled areas depicted in FIG. 10.

Figure 11:
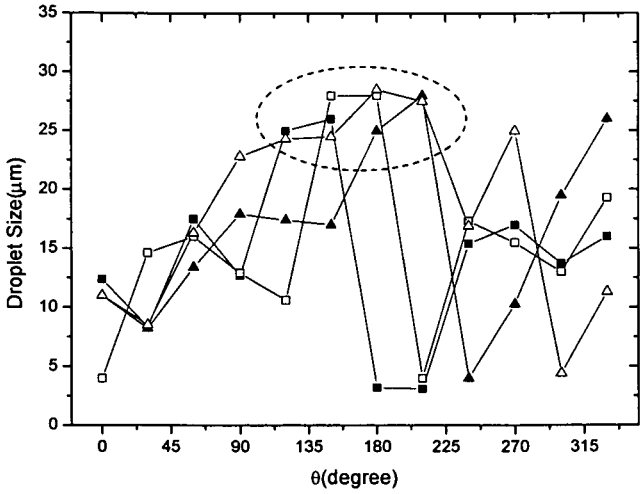
FIG. 11 depicts the average droplet diameter at different total flow rates in cone-jet electrosprays simultaneously anchored to the damaged grooved atomizer.
Figure 12:
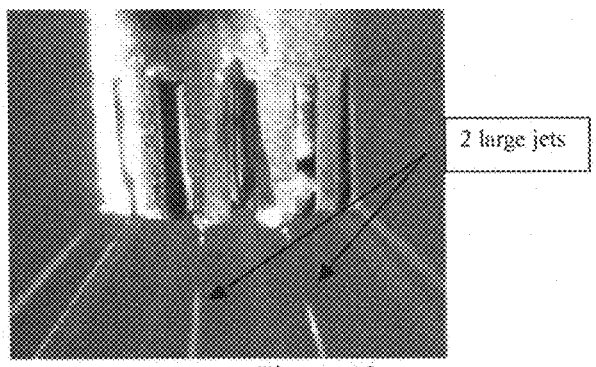
FIG. 12 depicts close-up views of asymmetric behavior in a damaged grooved atomizer.

Size measurements obtained with such a tube are shown in FIG. 11. The grooved mode was difficult to establish. A 12-jet pattern was actually obtained in a super-grooved mode, with one empty groove and another exhibiting a double jet. A 10-jet subgrooved mode looked more stable, with no time dependent behavior of the jets. However, non-uniformity in average size is dramatically worsened, as compared to FIG. 8. For each flow rate, the curves present a peak, which corresponds to two neighboring jets of relatively large droplet size and hence high flow rate. These two jets were easy to localize on the edge of the tube because their ligaments were much longer than the others, which is consistent with a high flow rate through each jet. This double peak shifts in azimuthal position depending on the flow rate, as highlighted by the dashed ellipse in the figure. This can be explained by the fact that the spray was not operated in the grooved mode. For example, one extra jet had appeared in a slot where a jet was already anchored, at the beginning of super grooved mode, but the physical position around the edge of the tube remained the same regardless of flow rate. Moreover, as seen in FIG. 12, it appears that those two jets with larger flow rates were not anchored inside the slots, unlike the regular jets in grooved mode, but on the tip, whereas the neighbor slots were empty. The labeled jets in the figure correspond to the peak sizes within the elliptic region in FIG. 11.

Example 4

Further Multiplexing

Conventional machining with feature size significantly smaller than 0.002 inches has not been shown to be achievable. Examining FIG. 1, it can be seen that in principle, twice as many grooves (i.e., a total of 24), can be fitted on this particular atomizer. If the goal is to achieve an even higher level of multiplexing, the only avenue would be to multiplex grooved nozzles by brute force multiplication of the geometry in FIG. 1. Thus, three grooved nozzles were positioned at the vertices of an equilateral triangle and the behavior of a fourth nozzle positioned in the center of the triangle was observed. A reservoir that would distribute the liquid to the four nozzles, through plastic tubing, was machined. The plastic tubing allowed for the testing of the nozzles at distances ranging from 5 to 9 mm from the central nozzle. Because the multiplexed nozzles required a stronger electric field, the ground plate was moved up so that the nozzles were approximately 1 cm away from the ground. For any configuration, Coulombic repulsion of positively charged jets resulted in strong repulsion of cone-jets as they form. As the voltage was increased, the first cone jets would form on the outer radii of the 3 outer nozzles. They would have several cone-jets working before the central nozzle would establish its first few jets. By the time the central nozzle had developed a few of its 12 cone-jets, the potential difference had reached a level at which sparks connect from the nozzles to the ground plate. The only geometric arrangement that was able to establish 4 stably working nozzles (see FIG. 13) was with the 9 mm spacing, since the larger distance reduced the effects of Coulombic repulsion. Notice that the footprint of such an atomizer would be on the order of 94 $mm^2$ and would yield the generation of 48 cone-jets. As a result the multiplexing density is a respectable 1 cone-jet for every 2 $mm^2$, that is a factor of three smaller than the value obtained for a single grooved atomizer. Of course, since this behavior is dependent on space charge effects, results may differ with liquids of different physical properties. The present approach to multiplexing was realized through either conventional machining or wire EDM. But any other manufacturing technique capable of "writing" features accurately and with good spatial resolution is feasible. Multiplexing using conventional machining may allow for multiplexing by no more than one or two orders of magnitude. The multiplexing goal may become easier to tackle with recent progress in the field of MEMS (micro-electro mechanical systems), namely, by adapting conventional silicon integrated circuit fabrication technology (micromachining) to the manufacturing of electrospray sources, multiplexing devices at unparalleled scales and with micron precision may become feasible. A typical microlithographic process flow uses silicon wafers and Deep Reactive Ion Etch (DRIE) of silicon. Minimum feature sizes can be 1's of microns, which guarantees virtually identically features, each anchoring one or more cone-jet. Also, on a given circumference hundreds of grooves can be "written", thereby increasing the multiplexing factor. Depending on the orifice material, other techniques are feasible using photolithography and metal etching to tolerances compatible with DRIE, including (but not exclusively): (1) microlithography with electro or electroless plating, (2) metallization, micro-lithographic patterning, etch and release, and (3) one sided or two sided metallization of a microlithographically patterned and bulk etched insulating platform.

It can thus be seen that the present invention provides for significant advances over the prior art for a multiplexing system for producing multiple monodispersed cone-jet electrosprays. The present invention can be used in many applications that use electrospray and that could be improved via the advantages that come from multiplexing (e.g., decreasing the mean size of the generated droplets at a given flow rate without comprising size uniformity). Suitable candidates include any application requiring tight control of size distribution of the generated droplets and benefiting from operation at larger flow rates than those reachable with a single electrospray. Examples include liquid fuel combustion for power generation, drug inhalation, synthesis of various particles from liquid precursors and surface coating, by way of example and not limitation.

It is also to be understood that the following claims are intended to cover all of the generic and specific features of the invention described herein and all statements of the scope of the invention which as a matter of language might fall therebetween.

What is claimed is:

1. A microfabricated multiplex system for electrospraying an electrosprayable fluid to produce droplets of essentially uniform size from multiple conejets from an integral array of substantially uniform nozzles, the system comprising:

a) an integral array of substantially uniform nozzles capable of producing droplets of essentially uniform size from multiple conejets, said multiple conejets produced when a liquid is fed through each of the array of substantially uniform nozzles and a liquid meniscus at an outlet of each of the substantially uniform nozzles forms a conical shape under an action of an electrical field with a thin jet emerging from the cone tip that breaks up into a spray of fine, charged droplets;

b) at least one extractor electrode array positionable at a distance from the top of the array of nozzles;

c) a source of fluid operably connected to the array of substantially uniform nozzles for providing the fluid to be electrosprayed; and d) electrical means for maintaining a desired voltage drop between the array of substantially uniform nozzles and the at least one extractor electrode array.

2. The multiplex system according to claim 1, wherein an outlet of each nozzle of the array of nozzles is substantially cylindrical.

3. The multiplex system according to claim 1, wherein the outlet of each nozzle of the array of nozzles comprises a tube that is fabricated from a conductive material or a metallized non-conductive material.

4. The multiplex system according to claim 3, wherein the outlet of each nozzle of the array of nozzles is shaped for intensifying the electrical field at discrete points around the perimeter by arranging a plurality of geometric features at least substantially symmetrically around a perimeter of the outlet of the tub; wherein the electrosprayable fluid is capable of being anchored to each of the plurality of geometric features such that at least one cone jet is anchorable to each of the plurality of geometric features.

5. The multiplex system according to claim 4, wherein the geometric features are selected from channels, grooves, ridges, pins, teeth, and other means that are capable of locally increasing the electric field by reducing the local radius of curvature of the surface of the perimeter of the outlet of the tube.

6. The multiplex system according to claim 5, wherein the geometric features are grooves or channels that are created in the perimeter of the outlet of the tube by wire electrical discharge machining.

7. The multiplex system according to claim 4, wherein the plurality of geometric features comprises at least three geometric features arranged at least substantially symmetrically and equidistant from each other around the perimeter of the outlet of the tube.

8. The multiplex system according to claim 7, wherein the plurality of geometric features comprises at least twelve geometric features arranged at least substantially symmetrically and equidistant from each other around the perimeter of the outlet of the tube.

* * * * *